US010172207B1

(12) United States Patent
Hsu

(10) Patent No.: US 10,172,207 B1
(45) Date of Patent: Jan. 1, 2019

(54) ADJUSTABLE LIGHT COLOR TEMPERATURE SWITCHING CIRCUIT

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd., Guang Dong (CN)

( * ) Notice: Subject to any disclaimer, the term of this patent is extended or adjusted under 35 U.S.C. 154(b) by 0 days.

(21) Appl. No.: 15/859,791

(22) Filed: Jan. 2, 2018

(51) Int. Cl.
*H05B 37/02* (2006.01)
*H05B 33/08* (2006.01)

(52) U.S. Cl.
CPC ..... *H05B 33/0857* (2013.01); *H05B 33/0812* (2013.01); *H05B 33/0815* (2013.01); *H05B 33/0827* (2013.01); *H05B 33/0845* (2013.01)

(58) Field of Classification Search
CPC ..... H05B 33/0812; H05B 33/0815; H05B 33/0827; H05B 33/0845; H05B 33/0857
USPC ..... 315/192, 193
See application file for complete search history.

(56) References Cited

U.S. PATENT DOCUMENTS 9,655,209 B1 * 5/2017 Xi ..... H05B 33/0854
2004/0196225 A1 * 10/2004 Shimada ..... G09G 3/005 345/82
2006/0192728 A1 * 8/2006 Kim ..... G09G 3/3413 345/46
2008/0252197 A1 * 10/2008 Li ..... H05B 33/0818 313/502
2017/0006684 A1 * 1/2017 Tu ..... H05B 33/083
2017/0290123 A1 * 10/2017 Wu ..... H05B 33/0857
2018/0103518 A1 * 4/2018 Janik ..... H05B 33/0845
2018/0103523 A1 * 4/2018 Yan ..... H05B 33/0845
2018/0231226 A1 * 8/2018 Koo ..... F21V 23/04

* cited by examiner

*Primary Examiner* — Tung X Le
(74) *Attorney, Agent, or Firm* — Alan D. Kamrath; Kamrath IP Lawfirm, P.A.

(57) ABSTRACT

An adjustable light color temperature switching circuit includes an input module, a drive power supply connected with the input module, a regulating switch module connected with the drive power supply, a control module connected with the drive power supply and the regulating switch module, and an LED module connected with the regulating switch module. The control module includes a control chip. The LED module includes at least one first LED, at least one second LED and at least one third LED. Thus, the control chip of the control module is connected with the regulating switch module, to regulate the state of the regulating switch module, so that the at least one first LED, the at least one second LED and the at least one third LED are combined freely according to the practical requirement.

2 Claims, 1 Drawing Sheet

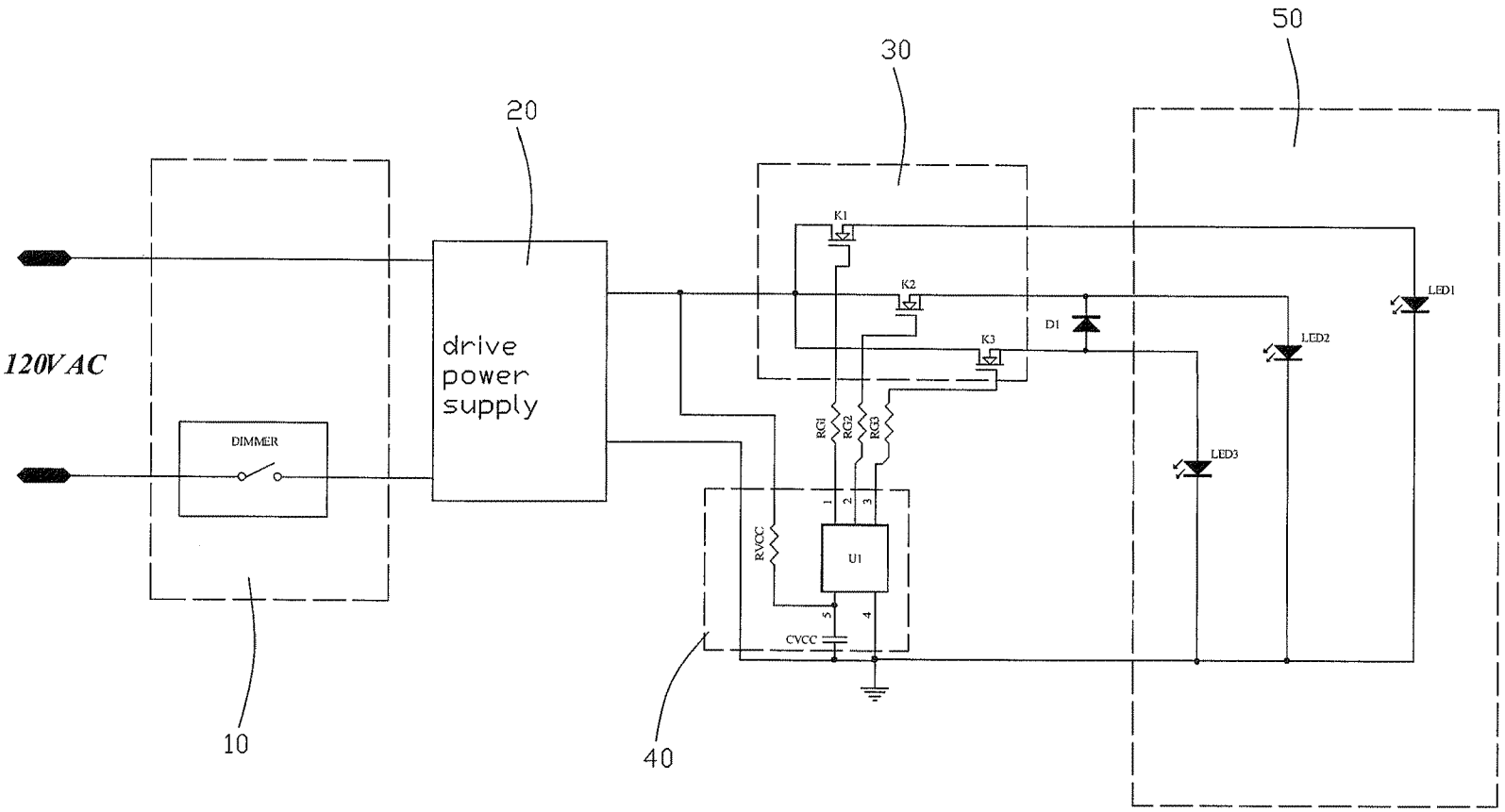
50
LED1
LED2
LED3
D1
30
K1
K2
K3
RG1
RG2
RG3
U1
1
2
3
4
5
RVCC
CVCC
40
20
drive
power
supply
10
DIMMER
120VAC

ADJUSTABLE LIGHT COLOR TEMPERATURE SWITCHING CIRCUIT

BACKGROUND OF THE INVENTION

1. Field of the Invention

The present invention relates to a circuit and, more particularly, to an adjustable light color temperature switching circuit.

2. Description of the Related Art

A conventional LED circuit comprises at least one warm light LED and at least one cold light LED. The at least one warm light LED and the at least one cold light LED are combined and controlled to achieve the purpose of color temperature control. However, the conventional LED circuit has a complicated construction, thereby increasing the cost of assembly, production and fabrication. In addition, the conventional LED circuit has a poor color temperature changing effect, and cannot satisfy the requirement of the consumers.

BRIEF SUMMARY OF THE INVENTION

The primary objective of the present invention is to provide an adjustable light color temperature switching circuit.

In accordance with the present invention, there is provided a circuit comprising an input module, a drive power supply connected with the input module, a regulating switch module connected with the drive power supply, a control module connected with the drive power supply and the regulating switch module, and an LED module connected with the regulating switch module. The drive power supply includes an output terminal and a grounding terminal. The regulating switch module includes a first regulating switch, a second regulating switch and a third regulating switch. Each of the first regulating switch, the second regulating switch and the third regulating switch has an input terminal, an output terminal and a control terminal. The input terminal of each of the first regulating switch, the second regulating switch and the third regulating switch is connected with the output terminal of the drive power supply. The control module includes a control chip. The control chip includes three signal terminals, a power supply terminal and a grounding terminal. The three signal terminals of the control chip are respectively connected with the control terminal of the first regulating switch, the control terminal of the second regulating switch and the control terminal of the third regulating switch. The LED module includes at least one first LED, at least one second LED and at least one third LED. The at least one first LED is a warm light type LED. Each of the at least one second LED and the at least one third LED is a cold light type LED. Each of the at least one first LED, the at least one second LED and the at least one third LED includes an input terminal and a grounding terminal. The input terminal of the at least one first LED, the input terminal of the at least one second LED and the input terminal of the at least one third LED are respectively connected with the output terminal of the first regulating switch, the output terminal of the second regulating switch and the output terminal of the third regulating switch.

Preferably, the three signal terminals of the control chip are respectively connected with the control terminal of the first regulating switch, the control terminal of the second regulating switch and the control terminal of the third regulating switch through a first inductor, a second inductor and a third inductor.

Preferably, the control module further includes an inductor and a capacitor. The power supply terminal of the control chip is connected with the output terminal of the drive power supply through the inductor and is connected with the grounding terminal of the drive power supply through the capacitor.

According to the primary advantage of the present invention, the control chip of the control module is connected with the regulating switch module, to regulate the state of the regulating switch module, so that the at least one first LED, the at least one second LED and the at least one third LED are combined freely according to the practical requirement, so as to achieve the purpose of regulating the color temperature by provision of the control module.

According to another advantage of the present invention, the adjustable light color temperature switching circuit has a simplified construction that provides an excellent color temperature changing effect.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 1 is a circuit diagram of an adjustable light color temperature switching circuit in accordance with the preferred embodiment of the present invention.

DETAILED DESCRIPTION OF THE INVENTION

Referring to FIG. 1, an adjustable light color temperature switching circuit in accordance with the preferred embodiment of the present invention comprises an input module 10, a drive power supply 20 connected with the input module 10, a regulating switch module 30 connected with the drive power supply 20, a control module 40 connected with the drive power supply 20 and the regulating switch module 30, and an LED module 50 connected with the regulating switch module 30. The adjustable light color temperature switching circuit is used to regulate the color temperature of the LED module 50 during utilization. The drive power supply 20 provides an electric power to the control module 40. The control module 40 regulates the state of the regulating switch module 30, to further adjust the color temperature of the LED module 50 when working.

The drive power supply 20 includes an output terminal and a grounding terminal.

The regulating switch module 30 includes a first regulating switch K1, a second regulating switch K2 and a third regulating switch K3. Each of the first regulating switch K1, the second regulating switch K2 and the third regulating switch K3 has an input terminal, an output terminal and a control terminal. The input terminal of each of the first regulating switch K1, the second regulating switch K2 and the third regulating switch K3 is connected with the output terminal of the drive power supply 20.

The control module 40 includes a control chip U1, an inductor RVCC and a capacitor CVCC. The control chip U1 has a memory function so that every time when the control chip U1 is turned on again, the control chip U1 keeps the state before the control chip U1 is turned off. The control chip U1 includes three signal terminals, a power supply terminal and a grounding terminal. The power supply terminal of the control chip U1 is connected with the output terminal of the drive power supply 20 through the inductor RVCC and is connected with the grounding terminal of the drive power supply 20 through the capacitor CVCC. The three signal terminals of the control chip U1 are respectively connected with the control terminal of the first regulating switch K1, the control terminal of the second regulating switch K2 and the control terminal of the third regulating switch K3 through a first inductor RG1, a second inductor RG2 and a third inductor RG3. In operation, the three signal terminals of the control chip U1 output level signals to turn on or turn off the first regulating switch K1, the second regulating switch K2 and the third regulating switch K3.

The LED module 50 includes at least one first LED "LED1", at least one second LED "LED2" and at least one third LED "LED3". The at least one first LED "LED 1" is a warm light type LED. Each of the at least one second LED "LED2" and the at least one third LED "LED3" is a cold light type LED. Each of the at least one first LED "LED1", the at least one second LED "LED2" and the at least one third LED "LED3" includes an input terminal and a grounding terminal. The input terminal of the at least one first LED "LED1", the input terminal of the at least one second LED "LED2" and the input terminal of the at least one third LED "LED3" are respectively connected with the output terminal of the first regulating switch K1, the output terminal of the second regulating switch K2 and the output terminal of the third regulating switch K3.

The adjustable light color temperature switching circuit further comprises a diode D1. The diode D1 has a positive pole connected with the input terminal of the at least one third LED "LED3" and a negative pole connected with the input terminal of the at least one second LED "LED2".

In operation, the control module 40 regulates the state of the regulating switch module 30. In addition, the first regulating switch K1 controls the at least one first LED "LED 1" independently, the second regulating switch K2 controls the at least one second LED "LED2" independently, and the third regulating switch K3 controls the at least one second LED "LED2" and the at least one third LED "LED3" simultaneously.

In such a manner, when the second regulating switch K2 is turned on and the third regulating switch K3 is turned off, then the at least one second LED "LED2" is turned on and the at least one third LED "LED3" is turned off.

In addition, when the third regulating switch K3 is turned on, the at least one second LED "LED2" and the at least one third LED "LED3" are turned on simultaneously even if the second regulating switch K2 is turned off.

Accordingly, the control chip U1 of the control module 40 is connected with the regulating switch module 30, to regulate the state of the regulating switch module 30, so that the at least one first LED "LED1", the at least one second LED "LED2" and the at least one third LED "LED3" are combined freely according to the practical requirement, so as to achieve the purpose of regulating the color temperature by provision of the control module 40. In addition, the adjustable light color temperature switching circuit has a simplified construction that provides an excellent color temperature changing effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A circuit comprising:

an input module;

a drive power supply connected with the input module;

a regulating switch module connected with the drive power supply;

a control module connected with the drive power supply and the regulating switch module; and an LED module connected with the regulating switch module, wherein:

the drive power supply includes an output terminal and a grounding terminal;

the regulating switch module includes a first regulating switch, a second regulating switch and a third regulating switch;

each of the first regulating switch, the second regulating switch and the third regulating switch has an input terminal, an output terminal and a control terminal;

the input terminal of each of the first regulating switch, the second regulating switch and the third regulating switch is connected with the output terminal of the drive power supply;

the control module includes a control chip;

the control chip includes three signal terminals, a power supply terminal and a grounding terminal;

the three signal terminals of the control chip are respectively connected with the control terminal of the first regulating switch, the control terminal of the second regulating switch and the control terminal of the third regulating switch;

the LED module includes at least one first LED, at least one second LED and at least one third LED;

the at least one first LED is a warm light type LED;

each of the at least one second LED and the at least one third LED is a cold light type LED;

each of the at least one first LED, the at least one second LED and the at least one third LED includes an input terminal and a grounding terminal; and the input terminal of the at least one first LED, the input terminal of the at least one second LED and the input terminal of the at least one third LED are respectively connected with the output terminal of the first regulating switch, the output terminal of the second regulating switch and the output terminal of the third regulating switch; and wherein:

the control module further includes an inductor and a capacitors; and the power supply terminal of the control chip is connected with the output terminal of the drive power supply through the inductor and is connected with the grounding terminal of the drive power supply through the capacitor.

2. The circuit of claim 1, wherein the three signal terminals of the control chip are respectively connected with the control terminal of the first regulating switch, the control terminal of the second regulating switch and the control terminal of the third regulating switch through a first inductor, a second inductor and a third inductor.

* * * * *